United States Patent [19]

Maki

[11] Patent Number: 4,669,385

[45] Date of Patent: Jun. 2, 1987

[54] WAD FOR SHOTGUN SHOTSHELL

[76] Inventor: Nagatoshi Maki, 2-48-4, Kamiishihara, Chofu, Japan

[21] Appl. No.: 646,937

[22] Filed: Sep. 4, 1984

[30] Foreign Application Priority Data

Sep. 28, 1983 [JP] Japan ..... 58-178096
Nov. 25, 1983 [IT] Italy ..... 23903 A/83

[51] Int. Cl.[4] ..... F42B 7/08

[52] U.S. Cl. ..... 102/453; 102/532; 102/452; 102/457

[58] Field of Search ..... 102/448–463, 102/532; 244/3.23

[56] References Cited

U.S. PATENT DOCUMENTS

| | | | |
|---|---|---|---|
| 776,921 | 12/1904 | La Dow . | |
| 777,031 | 12/1904 | La Dow . | |
| 1,096,272 | 5/1914 | Sherman . | |
| 2,924,174 | 2/1960 | McLean . | |
| 3,058,423 | 10/1962 | Laager . | |
| 3,065,696 | 11/1962 | Kleinguenther . | |
| 3,074,344 | 1/1963 | Devaux . | |
| 3,138,102 | 6/1964 | Meyer et al. . | |
| 3,247,795 | 4/1966 | Abela . | |
| 3,398,682 | 3/1968 | Abela . | |
| 3,420,178 | 1/1969 | Rempel . | |
| 3,452,677 | 7/1969 | Abela . | |
| 3,507,220 | 4/1970 | McClure III . | |
| 3,750,579 | 8/1973 | Bellington . | |
| 3,881,421 | 5/1975 | Burczynski . | |
| 4,016,817 | 4/1977 | Blanco . | |
| 4,063,511 | 12/1977 | Bullard . | |
| 4,296,893 | 10/1981 | Ballmann . | |
| 4,301,733 | 11/1981 | Blanco . | |
| 4,506,605 | 3/1985 | Maki | 102/457 |

FOREIGN PATENT DOCUMENTS

| | | | |
|---|---|---|---|
| 866822 | 11/1978 | Belgium . | |
| 96460 | 6/1897 | Fed. Rep. of Germany . | |
| 43311 | 11/1933 | France | 102/457 |
| 1016766 | 11/1952 | France . | |
| 1223158 | 6/1960 | France . | |
| 1454361 | 9/1966 | France . | |
| 2066065 | 7/1971 | France . | |
| 2199861 | 4/1974 | France . | |
| 2218546 | 9/1974 | France . | |
| 2292948 | 6/1976 | France . | |
| 2372411 | 6/1978 | France . | |
| 620234 | 3/1961 | Italy . | |
| 606149 | 7/1983 | Italy . | |
| 18097 | 5/1905 | United Kingdom . | |
| 172710 | 12/1921 | United Kingdom . | |

*Primary Examiner*—Deborah L. Kyle
*Assistant Examiner*—T. J. Wallen
*Attorney, Agent, or Firm*—Merchant, Gould, Smith, Edell, Welter & Schmidt

[57] ABSTRACT

A wad for a shotgun shotshell with a crimped case, comprising a seal member located adjacent to a propellant in the case and a rotor opposed to the seal member. The seal member and the rotor are interconnected for relative sliding and rotation and have opposed end faces. The seal member has at least one explosion gas passage hole. The rotor has, on the end face opposed to the seal member, gas jet grooves which are spaced from the axis and which extend in a predetermined direction to be connected to the outer periphery of the rotor and to the hole of the seal member. The rotor has blades or male-female connectors for transmitting the rotation of the rotor to a projectile in the case.

23 Claims, 31 Drawing Figures

WAD FOR SHOTGUN SHOTSHELL

BACKGROUND OF THE INVENTION

1. Field of the Invention

This invention relates to a wad for a shotgun shotshell, which can be used, for example, with a sporting gun.

2. Description of the Prior Art

A shotshell for a shotgun for hunting or a shooting match has a case with a primer. In the case, powder (propellant), a wad, and a projectile, such as shot (below, "pellets") or a slug, are charged. The case is provided, on its front end, with a crimp for preventing the projectile from coming out of the case.

Pellet projectiles are useful for shooting moving targets, such as flying birds, or for skeetshooting since the pellets fired from the shotgun spread out when flying toward the target. So long as the target is in the range of the spread of the pellets, the pellets can hit the target. Shotshells available on the market, however, have a small angle of spread and are not suitable for short-distance shooting.

Slug projectiles, which can be loaded in shotguns in place of pellet projectiles, are useful for shooting larger animals or immovable targets. The hit probability of the slug depends on the stability of the travelling attitude of the slug after being fired from the muzzle. In order to ensure the stability of the slug, it is known to fire the slug while rotating the same about its axis. The rotation of the slug contributes to increased stability due to the so-called gyro-effect. However, since shotguns do not have rifling in the barrel, unlike rifle, it is impossible to rotate the slug at a high speed. As a result, the hit probability of the slug is considerably smaller than that with a rifle.

SUMMARY OF THE INVENTION

The primary object of the present invention is to provide a wad which rotates at a high speed due to part of the energy of the explosion of a propellant, such as powder, to increase the spread of the pellets and to provide a high hit probability of a slug. Namely, the present invention provides a wad which can be used not only for pellets but also for a slug. According to the present invention, there is provided a wad for a shotgun shotshell having a case which has therein a propellant and a projectile held in the case by a crimp provided on the case. The wad is located in the case between the propellant and the projectile and has a substantially cylindrical seal member, usually called over powder wad, located adjacent to the propellant for enclosing the propellant in the case and a substantially cylindrical rotor body opposed to the seal member. The seal member and the rotor are connected to each other for relative sliding contact and relative rotation and have opposed end faces perpendicular to the axis of the shotshell. The seal member has at least one hole for the passage of the explosion gas. The rotor is provided, on the end face opposed to the seal member, with a plurality of gas jet grooves which are spaced from the axis and which extend in predetermined directions to be connected to the outer periphery of the rotor and to the hole of the seal member by means of the grooves defining the gas passages. The rotor comprises at least one radial projection projecting outward from the rotor and means for transmitting the rotation of the rotor to the projectile.

The present invention is applicable to both projectiles in the form of pellets and in the form of single slugs.

BRIEF EXPLANATION OF THE DRAWINGS

The invention will be described in detail below with reference to the drawings, in which.

Figure 5:
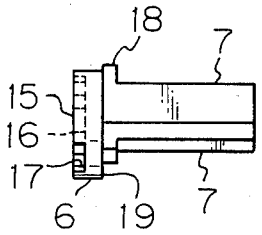
FIG. 5 is a side elevational view of a rotor for a pellet shotshell shown in FIG. 1.
Figure 6:
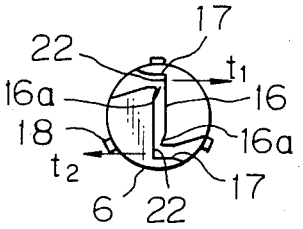
FIGS. 6 and 7 are left and right end views of a rotor shown in FIG. 5, respectively.
Figure 19:
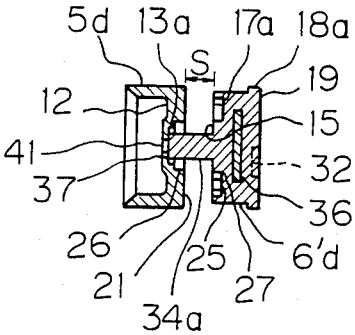
FIG. 19 is a sectional view of a modification of a combination of a seal member and a rotor.
Figure 25:
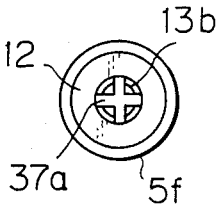
Figure 24:
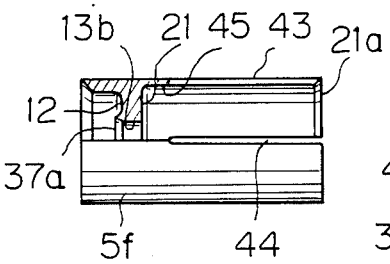
Figure 26:
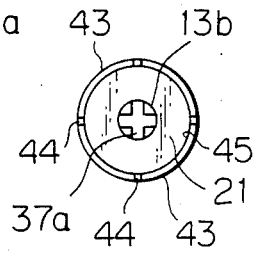
Figure 28:
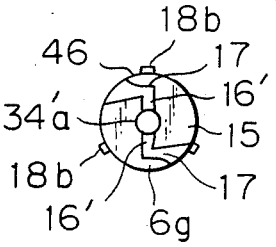
Figure 27:
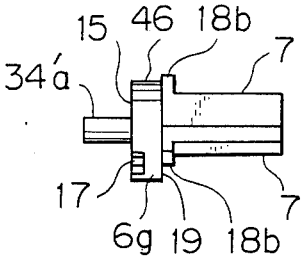
Figure 29:
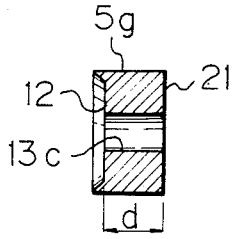
Figure 30:
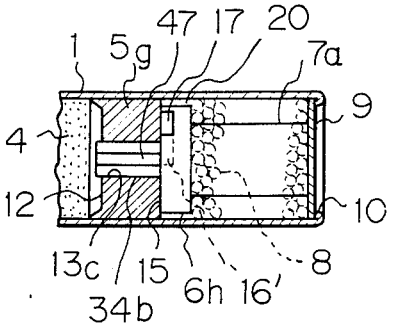
Figure 31:
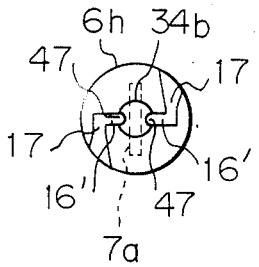

Fig, 24 is a partially sectioned side elevational view of a modified seal member from FIG. 19;

FIG. 25 is a left end view of FIG. 24;

FIG. 26 is a right end view of FIG. 24;

FIG. 27 is a side elevational view of a modified rotor from FIGS. 5 and 6;

FIG. 28 is a left end view of FIG. 27;

FIG. 29 is a side sectional view of a modified seal member along a plane including the axis of the seal member;

FIG. 30 is a partial side sectional view of a crimped case in which a propellant, the seal member shown in FIG. 29, a modified rotor, and pellets and a disc are incorporated; and, FIG. 31 is a left end view of the modified rotor shown in FIG. 30.

DESCRIPTION OF THE PREFERRED EMBODIMENTS

Figure 1:
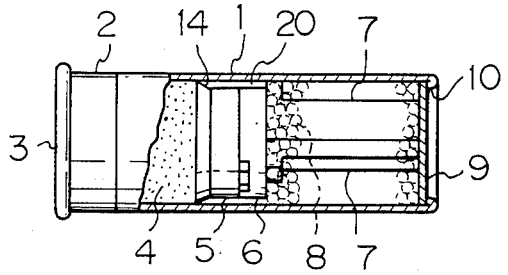
FIG. 1 is a partial sectional view of a shotshell incorporating a wad with pellets therein, according to the present invention.
Figure 2:
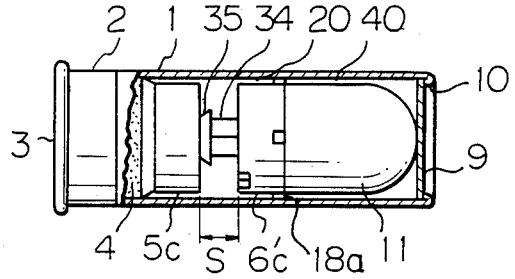
FIG. 2 is a partial sectional view of a shotshell incorporating a wad with a slug therein, according to the present invention.

FIGS. 1 and 2 show a pellet shotshell and slug shotshell, both incorporating a wad according to the present invention, respectively. In the figures, numeral 1 designates a case, 2 a brass base, 4 powder (propellant), 5 a seal member and 6 a rotor. The brass base 2 has an end face 3 which is provided with a primer (not shown). The seal member 5 and the rotor 6 constitute a wad of the present invention.

In the pellet shotshell shown in FIG. 1, the rotor 6 has blades 7 integral therewith which extend in directions parallel to the axial direction of the case 1. Between the blades 7 and the case 1 and on the periphery of the blades 7 are filled pellets 8 which are enclosed and prevented from coming out of the case 1 by means of a disc 9 which is, in turn, held in the case by a crimp 10 on the front end of the case 1.

In the slug shotshell shown in FIG. 2 a slug 11 is placed in the case 1 in place of the pellets 8 in FIG. 1. A rotor 6*c*′ is substantially similar to the rotor 6 shown in FIG. 1, except that the rotor 6*c*′ has a rotation transmitting means for transmitting the rotation to the slug 11, which transmitting means will be described in detail later.

Figure 3:
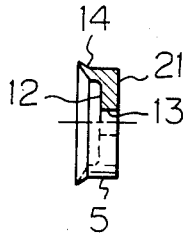
FIG. 3 is a side elevational view of a seal member in FIG. 1.
Figure 4:
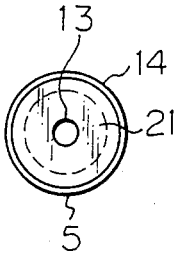
FIG. 4 is a right end view of FIG. 3.

In a first embodiment of the present invention, shown in FIGS. 3 and 4, the seal member 5 is made of a flexible plastic material, such as polyethylene, and is substantially cylindrical. The seal member 5 is provided, on its one face opposing the powder 4, with a recess 12. The seal member 5 has an axially extending center hole 13 which extends through the seal member 5 to provide an inlet passage for the explosion gas. The seal member 5 also has a conical projection 14 on the peripheral end of the seal member 5 adjacent to the recess 12. The conical projection 14 spreads outward, so that it comes into close contact with the inner periphery of the case 1 to prevent leakage of the explosion gas therethrough. Alternatively, it is also possible to omit the conical projection 14 and provide a seal member 5*d* which has a diameter substantially equal to the inner diameter of the case 1, as shown in FIG. 19.

The rotor 6 is substantially cylindrical and is preferably made of a plastic material having a small friction coefficient. The axial length of the rotor is not limited. The diameter of the rotor 6 is smaller than the inner diameter of the case 1, which is in turn substantially identical to the inner diameter of the barrel of the shotgun (not shown).

Figure 7:
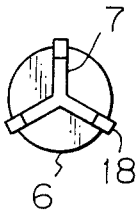

As can be seen from FIGS. 5 to 7, the rotor 6 has an end face 15 which is opposed to an end face 21 of the seal member 5 far from the recess 12 and which has a gas flowing groove (connecting groove) 16 having restrictions 16*a* for restricting the gas flow. The groove 16 extends across the center of the rotor 6. On the rear end face 15 are also formed a plurality of jet grooves 17 which are connected to the terminal ends of the gas flow groove 16 and which extend in predetermined directions. The jet grooves 17 start at starting points 22 and terminate at the periphery of the rotor 6. That is, the jet grooves 17 are connected to the outer periphery of the rotor 6.

Further, the rotor 6 has a plurality of projections, or at least one annular projection or ridge, integral with the rotor. The projections (projection) come into contact with the inner periphery of the case 1 to provide a uniform gap 20 (FIG. 1) between the outer periphery of the rotor 6 and the inner periphery of the case 1. In the embodiment illustrated in FIGS. 5 to 7, the three projections 18 are provided on the three blades 7. The number of the projection(s) 18 and the blades 7 is not limited to three.

The wad having the seal member 5 shown in FIGS. 3 and 4, and the rotor 6 shown in FIGS. 5 to 7 operates in combination as follows. The seal member 5 and the rotor 6 are located in the case 1 so that the end face 21 of the seal member 5 and the end face 15 of the rotor 6 face to and come into contact with each other. When the powder 4 is exploded, the seal member 5, the rotor 6, the pellets 8, and the disc 9 are pushed forward together by the explosive pressure to release the crimp 10, enter the barrel (not shown), pass through the barrel at a rapidly increasing speed, and finally are fired from the muzzle (not shown) at a high speed.

Since the end face 21 of the seal member 5 which is subjected to the explosive pressure comes into press contact with the end face 15 of the rotor 6, the gas flowing groove 16 and the jet grooves 17 on the rotor 6 are covered by the end face 21 of the seal member 5, so that a gas passage having a closed loop section is formed between the rotor 6 and the seal member 5 independently of the relative angular position, i.e., the relative angular phase of the opposed two end faces of the rotor 6 and the seal member 5. Since the gas flowing groove 16 is connected to the hole 13 of the seal member 5, the explosion gas entering the hole 13 enters the gas flowing groove 16 and the jet grooves 17 and then is ejected from the outer periphery of the rotor 6 into the gap 20 which has a uniform width surrounding the periphery of the rotor 6 and the seal member 5; this uniform width can be ensured by the three projections 18 (FIGS. 1, 5, 6 and 8). A reaction force of the adiabatic expansion due to the gas jet acts on starting points 22 of the jet grooves 17, so that causing torques due to the prepellant forces $t_1$ and $t_2$ (FIG. 6), which are indentical in magnitude to each other and are opposite in direction to one another, resulting in the rotation of the rotor 6. Thus, the rotor 6 passes through the barrel while rotating.

The explosion gas ejected into the gap 20 flows through a front end face 19 (FIG. 5) of the rotor 6 opposed to the rear end face 15 into spaces between the pellets 8, so that the reduced high-pressure explosion gas blows off the light weight disc 9 and then is discharged from the muzzle. Note: Since the explosive gas ejected into the gap 20 is subject to an adiabatic expansion to be cooled therein, the gas passing through the spaces between the pellets 8 has a relatively low temperature, thus preventing the pellets from any accidental and undersirable adhesion or attachment to each other caused by heat.

By the rotation of the rotor 6 and, accordingly, by the rotation of the blades 7 integral with the rotor 6, the charged pellets 8 enter the barrel while rotating about the axis of the barrel at an increased speed. The pellets are then fired from the muzzle while spreading outward in the tangential directions of the rotational movement due to the inertia of the rotational movement.

Figure 8:
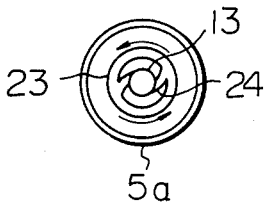
FIG. 8 is an end view of a seal member similar to FIG. 4, but in accordance with a second embodiment.
Figure 10:
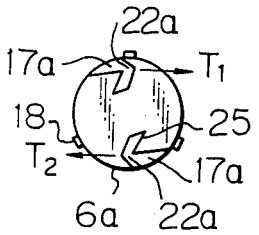
FIG. 10 is a left end view of a rotor which is to be engaged by the seal member shown in FIG. 8 or 9.

In a second embodiment of the wad according to the present invention, an annular groove 23 and connecting grooves 24 for connecting the annular groove 23 and the hole 13 are provided on the end face 21 of the seal member 5*a*, as shown in FIG. 8. For combination with this seal member 5*a* shown in FIG. 8, the rotor 6*a* has gas introduction grooves (connecting grooves) 25 and a plurality of jet grooves 17*a* connected to the corresponding introduction grooves 25 on the end face 15, as shown in FIG. 10. The connecting grooves 24 may be curved or straight and extend from the hole 13 in predetermined directions, so that the outer ends of the connecting grooves are connected to the annular groove 23. The introduction grooves 25 serve as restriction passages for restricting the gas flow therethrough. The introduction grooves 25 have starting points located on an imaginary circle corresponding to the inner diameter of the annular groove 23. The terminal ends of the introduction grooves 25 are connected, as mentioned before, to the corresponding jet grooves 17*a* which are in turn connected to the outer periphery of the rotor 6*a*.

The wad according to the second embodiment operates as follows. When the powder 4 is exploded, the end face 21 of the seal member 5*a* comes into press contact with the end face 15 of the rotor 6*a*, so that gas passages are provided between the two end faces, similar to the first mentioned embodiment. Consequently, the high pressure explosion gas entering the hole 13 of the seal member 5*a* enters the connecting grooves 24 and then the annular groove 23 from the predetermined directions of the connecting grooves 24. As a result, the explosion gas circularly flows at a high speed in the annular groove 23 in the directions designated by the arrows in FIG. 8. The circulation of the explosion gas in the annular groove 23 occurs in the clockwise direction when viewed from the side of the powder 4. Therefore, the circulated gas enters the introduction grooves (connecting grooves) 25 at a high speed, since the annular groove 23 is connected to the introduction grooves 25 of the rotor 6*a*. The gas entering the introduction grooves 25 suddenly changes in direction of flow at the starting points 22*a* at which the jet grooves 17*a* are connected to the introduction grooves. The gas then comes into the jet grooves 17*a* and is ejected therefrom into the gap 20 (FIG. 1). The reaction force of adiabatic expansion due to the jet of the gas and the impacting force produced when the gas flow changes in direction as mentioned above at the starting points 22*a* both act on the rotor 6*a* in the same direction. Namely, the reaction force and the impacting force provide the propellant forces $T_1$ and $T_2$ (FIG. 10). It will be easily understood that the propellant forces $T_1$ and $T_2$ in the second embodiment are larger than the propellant forces $t_1$ and $t_2$ in the first embodiment. That is, a larger torque can be obtained in the second embodiment. Due to the large torque, the rotor 6*a* rotates in the clockwise direction when viewed from the side of the power 4, at higher speed.

It should be noted here that the reaction force by the gas flow in the connecting grooves 24 gives a counter torque on the seal member 5*a* in the direction opposite to the direction of the circulation of the gas flow. Therefore, the seal member tends to idle in the opposite direction due to the counter torque. Therefore, in order to eliminate the possibility of the idling of the seal member 5*a*, it is possible to increase the depth of the recess 12 (FIG. 3) which is provided on the rear end face opposite to the end face 21 in which the connecting grooves 24, etc., are formed, so that the outer periphery of the barrel over a larger surface area when the seal member 5*a* expands outward due to the explosion gas pressure. The larger surface contact area of the outer periphery of the seal member with the inner periphery of the barrel increases the resistance against the rotation of the seal member.

The explosion gas prevailing in the grooves (23, 24, 27 . . . etc.) provided on the end faces 15 and 21 of the rotor and the seal member has an extremely high pressure. Accordingly, an extremely small amount of high pressure gas enters between the end faces 21 and 15 of the seal member 5*a* and the rotor 6*a*, respectively, although the end faces are in close and press contact with each other, as mentioned above. The gas entering between the end faces 21 and 15 tends to separate the rotor 6*a* from the seal member 5*a*, so that the slide friction resistance between the end faces can be decreased, which otherwise prevents the rotation of the rotor 6*a*.

Figure 9:
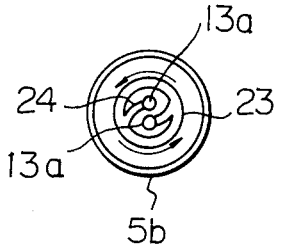
FIG. 9 is a variant of FIG. 8.

FIG. 9 shows a variant of the seal member shown in FIG. 8. In FIG. 9, the seal member 5*b* has a plurality of gas inlet holes 13*a* which extend parallel to the axis of the seal member and which are connected to the corresponding connecting grooves 24. The illustrated embodiment shows two gas inlet holes 13*a*, but more than two holes can be provided. Also, more than two connecting grooves 24 can be provided. The seal member 5*b* can be used in combination with the rotor 6*a* shown in FIG. 10. The operation of the wad having the seal member 5*b* and the rotor 6*a* is the same as that of the second embodiment mentioned above. Accordingly, no explanation therefor is given herein.

Figure 11:
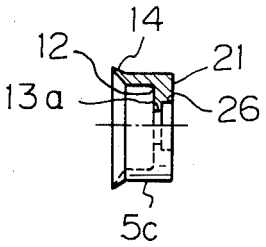
FIG. 11 is a side elevational view of a seal member, according to a third embodiment.
Figure 12:
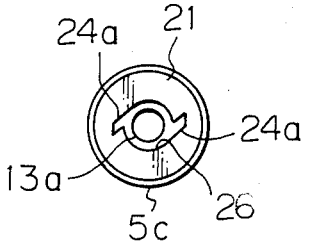
FIG. 12 is a right end view of FIG. 11.
Figure 13:
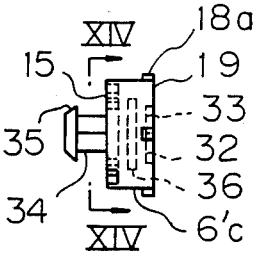
FIG. 13 is a side elevational view of a rotor for a slug shotshell.
Figure 14:
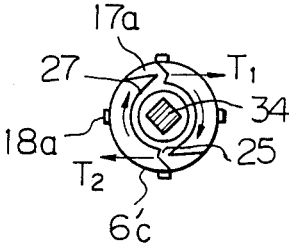
FIG. 14 is a sectional view taken along the line XIV—XIV in FIG. 13.
Figure 15:
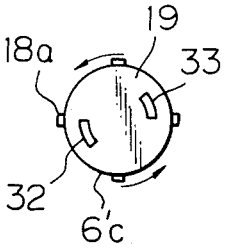
FIG. 15 is a right end view of a rotor shown in FIG. 13, which can be used with the seal member shown in FIGS. 11 and 12.

In a third embodiment, the wad has a seal member 5*c* shown in FIGS. 11 and 12 and a rotor 6*c*′ shown in FIGS. 13 to 15. The seal member 5*c* shown in FIGS. 11 and 12 is provided, on the front end face 21, with an annular gas guide hole 26 which is coaxial to the axis of the seal member 5*c* and which has a diameter larger than that of the central hole 13*a*, and with connecting grooves 24*a* which extend in predetermined directions and which are bifurcated from the gas guide hole 26, similar to the connecting grooves 24 shown in FIG. 8. On the other hand, the rotor 6*c*′ shown in FIGS. 13 to 15 has, on the rear end face 15, an annular groove 27 coaxial to the axis of the rotor and has introduction grooves (connecting grooves) 25 identical to the introduction grooves 25 in FIG. 10. The annular groove 27 is connected to the introduction grooves 25. The connecting grooves 24*a* of the seal member 5*c* are positioned so that the terminal ends of the connecting grooves 24*a* are located on an imaginary circle corresponding to the outer diameter of the annular grooves 27 of the rotor 6*c*′. On the outer periphery of the rotor 6*c*′ adjacent to the front end face 19 are provided a plurality of projections 18*a* which have the same function as that of the projections 18 shown in FIG. 5.

Figure 16:
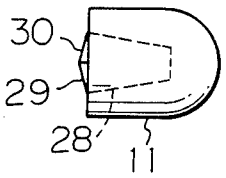
FIG. 16 is a side elevational view of a slug.
Figure 17:
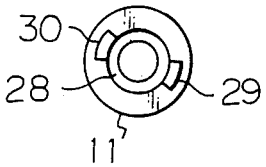
FIG. 17 is a left end view of FIG. 16.
Figure 18:
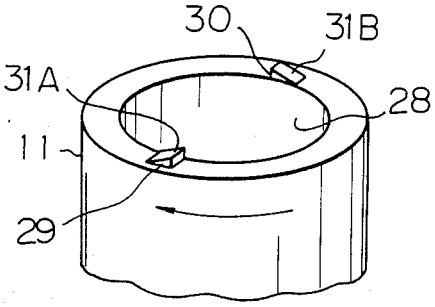
FIG. 18 is a partial enlarged perspective view of a slug shown in FIG. 16.

The slug 11 which is to be combined with the rotor 6*c*′ has a circular cylindrical body with a semispherical head, as shown in FIGS. 16 and 17. The diameter of the cylindrical body of the slug 11 is smaller than the inner diameter of the case 1 and of a choke portion of the barrel (not shown), so that a gap 40 is provided between the slug 11 and the case 1, as can be seen from FIG. 2. The slug 11 is provided, on its cylindrical body, with a center cavity 28. On the rear end face of the slug 11 apart from the semispherical head are provided projections 29 and 30 which are located on an imaginary same circle and which are diametrically arranged. The projections 29 and 30 have inclined upper surfaces 31A and 31B which are tapered in such a way that the height of the projections 29 and 30 gradually decreases in the direction of the rotational movement of the slug 11, as designated by the arrow in FIG. 18.

On the other hand, as can be seen from FIG. 15, corresponding recessed grooves 32 and 33 are provided on the end face 19 of the rotor 6c' and on a same imaginary circle, so that the projections 29 and 30 can engage in the corresponding recessed grooves 32 and 33 in the direction of the rotational movement of the slug 11. Furthermore, the rotor 6c' has a central rod 34 on the end face 15. The rod 34 can be inserted in the central hole 13a of the seal member 5c. The rod 34 has a cross-section smaller than that of the hole 13a, so that a gap serving as a gas passage can be provided between the rod 34 and the inner wall of the hole 13a when the end face 21 of the seal member 5c is brought into press contact with the end face 15 of the rotor 6c'. In the illustrated embodiment, the rod 34 has a regular square cross-section which is inscribed with a circle crosssection of the hole 13a.

The rod 34 has a conical frustum-shape stop 35 on its front end. The smallest diameter of the top of the frustum is larger than the diameter of the gas guide hole 26 of the seal member 5c, so that the end face 15 of the rotor 6c' is spaced from the end face 21 of the seal member 5c at a distance S (FIG. 2) when they are combined in the case 1.

FIG. 19 shows a variant of the third embodiment. In FIG. 19, the seal member 5d has an outer diameter substantially equal to the inner diameter of the case 1, so that the conical projection 14 as shown in FIG. 11 is dispensed with. The seal member 5d has a stop 37 located at the opening of the hole 13a adjacent to the powder 4 (FIGS. 2 and 19). The stop 37 is, for example, in the form of an easily breakable member, such as a film, layer, or band, having a thickness sufficient to hold a rod 34a of a rotor 6d'. The stop 37 may either entirely or partly close the hole 13. In the embodiment shown in FIG. 19, the stop 37 is in the form of an annular breakable film having a small center hole 41. Also, the member 37 can be easily molded together with the sealing member 5d. On the other hand, the rod 34a provided on the center of the end face 15 of the rotor 6d' has no stop 35, unlike the third embodiment shown in FIG. 13. The rod 34a comes into contact with the stop 37 of the seal member 5d, so that the distance S is given between the end face 21 of the seal member 5d and the end face 15 of the rotor 6d', as shown in FIG. 19.

Preferably, a reinforcement disc plate 36 made of, for example, metal with a high rigidity is embedded in the rotor 6c' or 6d' to prevent the rotor from deforming due to the explosive pressure.

The third embodiment and the variant thereof operates as follows. Immediately after the explosion of the powder 4, the seal member 5c or 5d acts to cause the slug 11 to move forward and come out of the case 1 by means of the front end face 19 of the rotor 6c' or 6d' through the rod 34 or 34a. The slug 11, however, is held by the disc 9, which is in turn held by the crimp 10. Accordingly, the rotor 6c' or 6d' cannot move forward against the crimp 10, so that the explosion pressure increases. By the increased explosion pressure in case of the embodiment shown in FIGS. 11 to 15, the hole 13a of the flexible seal member 5c expands. The stop 35 of the rod 34 thrusts through the hole 13a, resulting thus in press contact betweent the end face 21 of the seal member 5c and the end face 15 of the rotor 6c'. On the other hand, in case of the embodiment shown in FIG. 19, the stop 37 of the seal member 5d is broken, so that the two end faces 21 and 15 come into press contact with each other, similarly to the foregoing.

The displacement of the seal member 5c or 5d by the distance S (FIG. 2) during the initial stage of the explosion causes the expansion of the volume of the powder chamber in the case 1, so that the sudden increase of the explosion pressure is damped, resulting in a decrease of the peak value of the exposion pressure. This contributes to safe operation and also to a decreased recoil to the shoulder of the shooter.

After that, the explosion pressure increases, so that the crimp 10 is released. Consequently, the explosion gas which has entered the gap around the rod 34 or 34a and in the hole 13a passes through the gas guide hole 26 and the connecting grooves 24a, then comes in the annular groove 27 of the rotor 6c' or 6d' where the gas becomes a circulation flow in the directions designated by the arrow. When the gas flow comes into the introduction grooves 25, the gas flow changes in direction and then is ejected from the jet grooves 17a into the gap 20 (FIG. 2). The ejected gas, i.e., the exhaust gas, is discharged from the gap 40 into the barrel. Thus, the rotor 6c' or 6d' moves in the barrel while rotating at a high speed, similar to the second embodiment.

Figure 21:
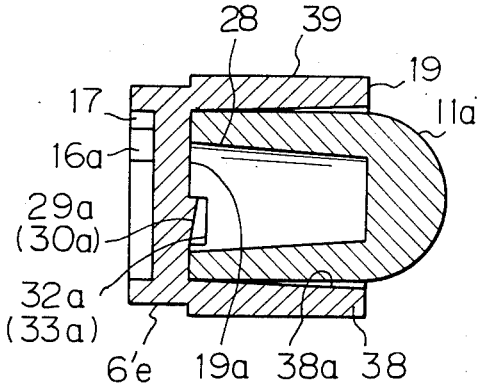
FIG. 21 is a sectional view taken along the line XXl—XXl in FIG. 20.

The rotation of the rotor 6c' or 6d' is transmitted to the slug 11 by means of the projections 29 and 30, so that the slug 11 can be fired from the muzzle while rotating at a high speed. It should be noted that since the slug 11 is made of metal, it is harder than the rotor 6c' or 6d', which is made of plastic. Furthermore, the rotor is brought into press contact with the slug 11 due to the explosion pressure. Therefore, the recessed grooves 32 and 33 can be dispensed with. Namely, even if the recessed grooves 32 and 33 are not provided on rotor 6c' or 6d', the rotation of the rotor can be surely transmitted to the slug 11, since the projections 29 and 30 of the slug 11 press into the end face 19 of the rotor 6c' or 6d'. However, in the case where the projections are dispensed with, centering means for ensuring coaxial aligmnent of the slug 11 with the associated rotor is necessary. Such centering means can be, for example, a tubular flange 38 provided on the rotor 6e', as shown in FIG. 21. The tubular flange 38 has a conical frustum-shaped bore 38a in which the peripheral rear or bottom end of the slug 11 is inscribed, so that the slug 11 is continuously held in the bore of the tubular flange of the rotor in coaxial aligmnent with the rotor.

As is well known, the shotgun may have a choke portion near the muzzle. For this kind of shotgun, when the rotor 6c' or 6d' passes through the barrel, the projections 18a are subject to frictional resistance at the choke portion, thus resulting in a decrease of the propellant speed and the rotational speed of the slug. Since the projections 29 and 30 have the tapered upper surfaces 31A and 31B (FIG. 18), however, the slug 11 separates from the associated rotor at the moment of reduction of the propellant speed and the rotational speed of the slug 11. Namely, the inclined projections 29 and 30 construct a one-way clutch. Accordingly, the separation of the slug from the associated rotor enables the slug 11 to pass through the barrel without coming into contact with the choke portion. Namely, a slug shotshell having a wad in which the slug is connected to the associated rotor by means of inclined projections which serve as one-way clutch, according to the present invention enables a high hit probability without adverse effects of the choke portion of the gun barrel.

As can be understood from the above discussion, in the above-mentioned embodiments, the blades 7 are transmitting means for transmitting the rotation to the projectile in the form of pellets, and the projections 29 and 30 and the recessed grooves 32 and 33 are similar transmitting means for the projectile in the form of a slug. That is, the present invention can be advantageously applied to a pellet shotshell as well as to a slug shotshell.

Figure 20:
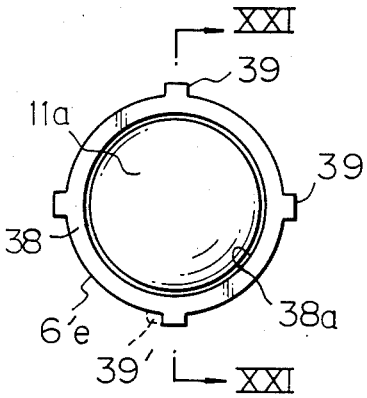
FIG. 20 is an enlarged end view of a different embodiment of a rotor for a slug shotshell.

Another application of the present invention is shown in FIGS. 20 and 21. In FIGS. 20 and 21, the rotor 6*e'* has the tubular flange 38 which has a conical frustum-shaped bore 38*a* opening to the front end 19, as mentioned before. The flange 38 has on its periphery a plurality of elogated projections 39 extending parallel to the axis of the rotor 6*e'*. On the bottom surface 19*a* of the bore 38*a* are provided projections 29*a* and 30*a* which have inclined upper surfaces similar to the projections 29 and 30 and which are located on a same imaginary circle. The projections 29*a* and 30*a* are also diametrically arranged, similar to the projections 29 and 30.

A slug 11*a* to be connected to the rotor 6*e'* is similar to the slug 11, except that recessed grooves 32*a* and 33*a* are provided on the slug in place of the projections 29 and 30. The projections 29*a* and 30*a* are engaged in the corresponding recessed grooves 32*a* and 33*a*. In this embodiment, the elongated projections 39 may be inclined with respect to the axis of the rotor 6*e'*, as shown at 39' in FIG. 20. Since the rotor 6*e'* is fired from the muzzle while keeping inscribing contact of the projections 39 with the inner periphery of the barrel, the slug 11*a* is also fired from the muzzle while in axial alignment with the axis of the barrel, thus resulting in a high hit probability. The rotor 6*e'* is preferably used in combination, with the seal member 5 shown in the first embodiment, wherein the transmission of the rotation and the operation one-way clutch due to the inclined projections 29*a* and 30*a* are the same as those of the foregoing. When the inner diameter of the bottom surface 19*a* (FIG. 21) is substantially identical to the outer diameter of the slug 11*a*, the projection 30*a* of the rotor 6*e'* and the recessed groove 33*a* of the slug 11*a* both can be dispensed with, allowing the provision of only one projection on the rotor 6*e'* for transmitting the rotation of the rotor to the slug 11*a*, since the slug 11*a* can be snugly inserted in the inner diameter of the rotor 6*e'*, without the need for the help of the projection 30*a*.

Figure 22:
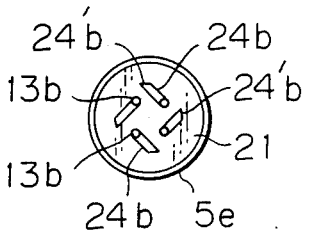
FIG. 22 is a right end view of a modified seal member from FIGS. 11 and 12.
Figure 23:
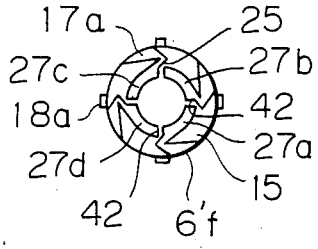
FIG. 23 is a left end view of a modified rotor from FIG. 13.

FIG. 22 shows a fourth embodiment of the present invention, which is a modification of FIGS. 9, and 11 to 15. As can be seen from FIG. 22, the seal member 5*e* has four holes 13*b* in place of the hole 13*a* (FIG. 9) and the gas guide hole 26 of the seal member 5*c* shown in FIGS. 11 and 12. The holes 13*b* extend from the bottom of the recess 12 to the end face 21. To the respective holes 13*b* are connected connecting grooves 24*b* which extend in the predetermined directions from the respective holes 13*b*. The rotor 6*f'* which is to be combined with the seal member 5*e* shown in FIG. 22 is illustrated in FIG. 23. The rotor 6*f'* is for the slug. The rod 34 as shown in FIG. 13 is dispensed with in the rotor 6*f'* shown in FIG. 23. Also, the annular grooves 27 of the rotor 6*f'* are composed of four discontinuous groove elements 27*a*, 27*b*, 27*c* and 27*d* which are separated from each other by partition walls 42. The introduction grooves 25 having the jet grooves 17*a* connected therto are connected to the respective separate annular groove elements 27*a*, 27*b*, 27*c*, and 27*d*. For other constructions, the rotor 6*f'* is similar to the rotor 6*c'* shown in FIGS. 13 to 15. In the fourth embodiment, the operation of the wad is similar to that of the wad of the above-mentioned third embodiment except that the explosion gas is introduced by the independent four holes 13*a* and that the seal member 5*e* and the rotor 6*f'* come into face contact with each other by means of the end faces when they are located in the case 1, since no rod 34 is provided, as mentioned before, thus resulting in no expansion of the powder chamber at the initial stage of the explosion.

The connecting grooves 24*b* of the seal member 5*e* are shaped and sized so that the front ends 24*b'* of the connecting grooves 24 bridge the adjacent two annular groove elements 27*a*, etc., when the front ends are located on the respective partition walls 42 of the rotor 6*f'*. Accordingly, the gas passages are not discontinued by the partition walls 42.

The fifth embodiment shown in FIGS. 24 to 28 is a wad having a seal member 5*f*, which is a modification of the seal member 5*d* shown in FIG. 19, and a rotor 6*g*, which is a modification of the rotor 6 shown in FIGS. 5 to 7.

As can be seen in FIGS. 24 to 26, the seal member 5*f* has, on the end face 21 thereof, a tubular extension 43 which has an outer diameter substantially equal to the inner diameter of the case 1. The tubular extension 43 extends in the axial direction of the seal member and is integral with the latter. The tubular extension 43 has, for example, four axially extending slits 44. Furthermore, in place of the stop 37 shown in FIG. 19, a stop 37*a* in the form of a cross-shaped band is provided on and molded integral with the seal member 5*f*. On the other hand, the rotor 6*g* shown in FIGS. 27 and 28 is similar to the rotor 6 shown in FIGS. 5 to 7 except that an axial center rod 34*a'* identical to the rod 34*a* provided on the rotor 6*d'* shown in FIG. 19 is provided on the end face 15. The provision of the rod 34*a'* causes the gas flowing passage on the end face 15 to be divided into two passages 16'. As mentioned before, the rod 34*a'* (identical to the rod 34*a*) has a cross-section smaller than that of the hole 13*b* of the seal member 5*f*, and accordingly, a gap is provided between the rod 34*a'* and the hole 13*b* for allowing the flow of the explosion gas therethrough. The explosion gas then enters the two gas flowing passages 16' and comes into the respective jet grooves.

The rotor 6*g* is received in the tubular extension 43 of the seal member 5*f* in such a way that the end face 15 of the rotor 6*g* is opposed to the end face 21 of the seal member 5*f*. Therefore, the distance S is provided between the two end faces by the engagement of the rod 34*a'* and the stop 37*a*, similarly to the third embodiment, as shown in FIG. 2. The projections 18*b* of the rotor 6*g* are such that the projections 18 come into snug contact with the inner surface 45 of the tubular extension 43. Also, since the diameter of the outer periphery 46 of the rotor 6*g* is smaller than the diameter of the inner surface 45 of the tubular extension 43, a uniform annular gap similar to the gap 20 as shown in FIGS. 1 and 2 is provided therebetween.

The operation of the fifth embodiment is similar to that of the embodiment shown in FIG. 19 except for the following points.

1. In comparison with FIG. 19, which shows the wad for a slug shotshell, the wad of the fifth embodiment is for a pellet shotshel. Accordingly, the blades 7 serve as a transmitter of the rotational movement of the rotor 6*g*.

2. The cross-shaped band-like stop 37*a* which is provided in place of the annular film 37 in FIG. 19 is broken by the front end of the rod 34*a'* at the explosion of the powder.

3. The explosion gas ejected from the jet grooves 17 enters the spaces between the pellets 8 charged between the tubular extension 43 and the blades 7 through the annular gap around the outer periphery 46 of the rotor 6*g* and then is discharged in the barrel.

4. The tubular extension 43 serves as a container of the pellets 8 which contributes to the prevention of the pellets 8 from deforming due to the contact of the pellets with the barrel during the passage of the seal member 5*f* in the barrel and also to the prevention of the lead, of which the pellets are made, from being stuck to the inner surface of the barrel.

It should be noted that the number of the jet grooves 17 and the passages 16' in FIGS. 27 and 28 is not limited to two but may be more than two.

It should also be noted that the discontinuous annular groove elements 27*a* etc. decrease the leakage of the explosion gas therethrough, in comparison with the continuous annular groove 27 during the circulation of the gas therein.

FIGS. 29 to 31 show a sixth embodiment of the wad according to the present invention, which embodiment is a modification of the first embodiment mentioned above.

The seal member 5*g* shown in FIG. 29 has no stop 37 (FIG. 19) and no annular gas guide hole 26 (FIG. 19). Instead, the seal member 5*g* has a hole 13*c* which is deeper than the hole 13*a* of the seal member 5*d*. In FIG. 29, the longer depth of the hole 13*c* is designated at "d".

On the other hand, the rotor 6*h* shown in FIGS. 30 and 31 has one blade 7*a* which has no projection on its periphery, and a central rod 34*b* with elongated channels 47 which extend in parallel to the axis of the rotor. The channels 47 are connected, at the ends thereof adjacent to the end face 15 of the rotor 6*h*, to the gas jet grooves 17 by means of the connecting grooves 16'.

As can be seen from FIG. 30, the central rod 34*b* of the rotor 6*h* is snugly fitted in the hole 13*c* of the seal member 5*g* for rotation. In the sixth embodiment, since the seal member 5*g* has a larger wall thickness in the axial direction, in comparison with, for example, FIG. 19, to allow the provision of the longer hole 13*c* of the length "d" (FIG. 29), the rotor 6*h* can be firmly held by the seal member 5*g* when the central rod 34*b* is inserted in the hole 13*c* of the seal member 5*g*, so that the rotor 6*h* can be put in the crimped case 1 coaxially to the latter to provide the uniform gap 20 around the periphery of the rotor 6*h* without the provision of the projections on the periphery of the rotor.

In the sixth embodiment, the explosion gas first enters the channels 47 and passes through the connecting grooves 16' and is then discharged from the gas jet grooves 17. The function of the sixth embodiment is the same as that of the first embodiment.

As can be seen from the above, according to the present invention, in case of a pellet shotshell, the pellets are fired from the muzzle after a fully high rotational speed is given to the pellets. Accordingly, the pellets are forced to spread to a wide range even if a choked barrel shotgun is used. It has been experimentally confirmed that a uniformly distributed wide pattern of the pellets is obtained according to the present invention. Further, in case of a slug shotshell, since the slug can be rotated at a high speed, the hit probability of the slug can be increased.

I claim:

1. A wad for shotgun shotshell having a case with primer which has therein a propellant and a projectile held in the case by a crimp provided on the case, said wad located in the case between the propellant and the projectile, comprising: a substantially cylindrical seal member located adjacent to the propellant for enclosing the propellant in the case to prevent the leakage of the explosion gas therethrough, and a rotor with a substantially cylindrical rotor body opposed to the seal member, said seal member and said rotor being connected to each other for relative rotation and having opposed end faces which are perpendicular to the axis of the shotshell and which are connected for relative surface contact sliding rotation when the opposed end faces come into contact with each other, said seal member having at least one hole for the passage of the explosion gas, and a recess which is located on the end face adjacent to the propellant to deform outwards the seal member by the explosion gas, said rotor being provided, on the end face opposed to the seal member, with a plurality of lidless gas jet grooves which are spaced from the axis and which extend in predetermined directions to be connected to the outer periphery of the rotor, said rotor being provided, on its outer periphery of the cylindrical rotor body, with a surrounding air space, said wad comprising at least one connecting lidless gas passage means defined by and between the rotor and the seal member, for connecting said hole on the seal member and the said lidless gas jet grooves on the rotor, said lidless gas jet grooves and the said connecting lidless gas passage means being both gas passages having a closed loop section to form complete closed gas passages when the opposed end faces of the rotor and the seal member come into press contact with each other due to the pressure caused by the explosion of the propellant, said rotor comprising means for transmitting the rotation of the rotor to the projectile without rotating the seal member.

2. A wad according to claim 1, wherein said connecting lidless gas passage means comprises at least one connecting groove provided on the end face of the seal member that is opposed to the rotor, said connecting groove extending in a predetermined direction and being connected to said hole of the seal member to connect the hole to the gas jet grooves on the rotor.

3. A wad according to claim 2, wherein said connecting lidless gas passage means further comprises an annular groove provided on the end face of the seal member that is opposed to the rotor, said annular groove being coaxial to the axis of the seal member and being connected to the connectig groove.

4. A wad according to claim 1, wherein said connecting lidless gas passage means comprises at least one connecting groove provided on the end face of the rotor that is opposed to the seal member, said connecting groove extending in a predetermined direction and being connected to said hole of the seal member to connect the hole to the gas jet grooves on the rotor.

5. A wad according to claim 4, wherein said connecting lidless gas passage means further comprises an annular groove provided on the end face of the rotor that is opposed to the seal member, said annular groove being coaxial to the axis of the rotor and being connected to the connecting groove.

6. A wad according to claim 3 or 5, wherein said annular groove is a continuous annular groove.

7. A wad according to claim 5 or 6, wherein said annular groove has discontinuous annular groove elements.

8. A wad according to claim 1, further comprising at least one projection provided on said rotor for projecting outward therefrom.

9. A wad according to claim 1, wherein said projectile is in the form of pellets.

10. A wad according to claim 9, wherein said transmitting means comprises at least one blade provided on the rotor and extending into the pellets.

11. A wad according to claim 1, wherein said projectile is in the form of a slug.

12. A wad according to claim 11, wherein said transmitting means comprises at least one projection which is provided on the rotor and which projects toward the slug.

13. A wad according to claim 12, wherein said projection on the rotor comprises a one-way clutch means which enables transmission of the rotation of the rotor only in one direction to the slug.

14. A wad according to claim 11, wherein said transmitting means comprises at least one projection provided on the rotor and at least one recessed groove which is provided on the slug and which is engaged by the projection on the rotor.

15. A wad according to claim 11, wherein said transmitting means comprises at least one projection which is provided on the slug and which projects toward the rotor.

16. A wad according to claim 15, wherein said projection on the slug comprises a one-way clutch means which enables transmission of the rotation of the rotor only in one direction to the slug.

17. A wad according to claim 11, wherein said transmitting means comprises at least one projection provided on the slug and at least one corresponding recessed groove provided on the rotor and engaged by the projection on the slug.

18. A wad according to claim 11, further comprising means for ensuring the axial alignment of the slug with respect to the rotor.

19. A wad according to claim 1, further comprising reinforcing means in the rotor for preventing the deformation of the rotor.

20. A wad according to claim 1, wherein said rotor has, on the end face opposed to the sealing member, a central rod projecting toward the sealing member, said rod having a cross-section smaller than that of the hole of the sealing member so that a gap is provided around the rod and in the hole when the rod is in the hole.

21. A wad according to claim 20, further comprising a stop means for normally preventing the rod from coming into the hole.

22. A wad according to claim 21, wherein said stop means comprises an enlarged stop provided on the rod, having a diameter slightly larger than the diameter of the hole of the sealing member.

23. A wad according to claim 21, wherein said stop means comprises a breakable member which is provided on one end of the hole and which can be broken by the central rod of the seal member at the explosion of the propellant.

* * * * *